US008303055B2

(12) United States Patent
Scheffknecht et al.

(10) Patent No.: US 8,303,055 B2
(45) Date of Patent: Nov. 6, 2012

(54) FURNITURE FLAP DRIVE FOR VARIOUS TYPES OF FLAPS

(75) Inventors: Uwe Scheffknecht, Höchst (AT); Gerald Friesenecker, Lauterauch (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/293,398

(22) Filed: Nov. 10, 2011

(65) Prior Publication Data

US 2012/0049709 A1 Mar. 1, 2012

Related U.S. Application Data

(63) Continuation of application No. PCT/AT2010/000160, filed on May 10, 2010.

(30) Foreign Application Priority Data

May 13, 2009 (AT) ..... A 730/2009

(51) Int. Cl.
*A47B 95/02* (2006.01)

(52) U.S. Cl. ..... 312/319.6; 312/325

(58) Field of Classification Search ..... 312/325, 312/322–323, 319.5–319.6; 49/246, 248; 160/213; 16/286
See application file for complete search history.

(56) References Cited

U.S. PATENT DOCUMENTS

| | | | | |
|---|---|---|---|---|
| 2,912,237 | A | 11/1959 | Snyder | |
| 5,462,347 | A * | 10/1995 | Vogelgesang et al. | 312/247 |
| 5,971,514 | A * | 10/1999 | Hayakawa | 312/319.2 |
| 6,442,799 | B1 * | 9/2002 | Duarte et al. | 16/277 |
| 6,877,830 | B2 * | 4/2005 | Salice | 312/327 |
| 7,178,202 | B2 * | 2/2007 | Hirtsiefer et al. | 16/366 |
| 7,448,703 | B2 * | 11/2008 | Kung | 312/327 |
| 7,500,287 | B2 * | 3/2009 | Brustle | 16/286 |
| 7,966,699 | B2 * | 6/2011 | Dubach et al. | 16/386 |
| 8,011,741 | B2 * | 9/2011 | Mattle | 312/319.5 |
| 8,029,078 | B2 * | 10/2011 | Gasser | 312/319.5 |
| 8,056,991 | B2 * | 11/2011 | Hollenstein | 312/312 |
| 8,066,341 | B2 * | 11/2011 | Brustle | 312/319.5 |
| 8,109,583 | B2 * | 2/2012 | Bruestle | 312/319.2 |
| 2006/0284530 | A1 * | 12/2006 | Hollenstein | 312/327 |
| 2007/0103041 | A1 * | 5/2007 | Kropf et al. | 312/333 |
| 2008/0100189 | A1 * | 5/2008 | Huber | 312/319.1 |

(Continued)

FOREIGN PATENT DOCUMENTS

AT 1352/2008 8/2008

(Continued)

OTHER PUBLICATIONS

International Search Report issued Sep. 3, 2010 in International (PCT) Application No. PCT/AT2010/000160.

(Continued)

*Primary Examiner* — Hahn V Tran

(74) *Attorney, Agent, or Firm* — Wenderoth, Lind & Ponack, L.L.P.

(57) ABSTRACT

A furniture flap drive is provided with a first component having an electric motor and with a second component having an adjustment arm, wherein the first component and the second component can be fastened releasably to each other, and a force transmission device is provided to move the adjustment arm, wherein a positioning device can be used to adjust the position of the force transmission device, and wherein the first component can be fastened to the second component in at least two, preferably at least three, different positions of the adjustment arm.

22 Claims, 18 Drawing Sheets

U.S. PATENT DOCUMENTS

| | | | | |
|---|---|---|---|---|
| 2008/0121490 | A1 * | 5/2008 | Dubach et al. | 192/17 D |
| 2010/0026153 | A1 | 2/2010 | Mattle | |

FOREIGN PATENT DOCUMENTS

| | | |
|---|---|---|
| AT | 505 613 | 3/2009 |
| DE | 20 2006 000 535 | 4/2006 |
| DE | 20 2007 006 689 | 10/2008 |
| EP | 1 788 179 | 5/2007 |
| WO | 2006/099645 | 9/2006 |
| WO | 2008/134786 | 11/2008 |
| WO | 2008/135300 | 11/2008 |
| WO | 2009/079671 | 7/2009 |
| WO | 2010/022413 | 3/2010 |

OTHER PUBLICATIONS

Austrian Patent Office Search completed Feb. 17, 2010 in Austrian Patent Application No. A 730/2009.

* cited by examiner

FURNITURE FLAP DRIVE FOR VARIOUS TYPES OF FLAPS

BACKGROUND OF THE INVENTION

This application is a Continuation of International application Serial No. PCT/AT2010/000160, filed May 10, 2010, the entire disclosure of which is incorporated herein by reference.

The invention concerns a furniture flap drive comprising a first component having an electric motor and a second component having an actuating arm, wherein the first component and the second component can be releasably fastened together and there is provided a force transmission device for moving the actuating arm.

WO 2008/134786 A1 discloses a flap mounted movably to a furniture carcass and having a mechanical actuating unit which has an actuating arm which can be connected to the flap and a force storage means acting on the actuating arm. In addition an electric drive in the form of a self-contained component can be fastened to the actuating unit, wherein fastening is possible even when the actuating unit is already mounted to the furniture carcass.

DE 20 2006 000 535 U1 shows furniture flaps of different design configurations or types. Thus for example there are furniture flaps which have become known as top flaps in which the flap is fastened rotatably at the underside of the top of the cupboard.

In addition there are flaps which are in two parts, wherein a first flap portion is rotatably connected to the furniture carcass and a second flap portion is rotatably connected to the first flap portion. When the flap is moved into the open position the first flap portion is pivoted upwardly away from the furniture carcass while the second flap portion is also pivoted upwardly towards the furniture carcass so that the flap is folded together in the open position. Such flaps have become known as upwardly foldable flaps.

A further type of flap is upwardly pivotable flaps, the flap being pivoted rearwardly away over the furniture carcass.

If the flap performs a movement during the entire opening or closing travel thereof substantially parallel to the front side of the furniture carcass, that is referred to as an upward lift flap.

That terminology is also to be retained in the context of the present application, in which respect the list of different types of furniture flaps is not to be interpreted as final.

Austrian application AT 1352/2008 discloses a furniture flap drive, wherein an identification device serves for automatic identification of the furniture flap type in the mounted condition of the furniture flap drive, to identify the respective type of furniture flap on the basis of the opening or closing angle measured with a measuring device. That makes manual presettings at the electric motor redundant.

Depending on the respective furniture flap type, different mechanical actuating units are used, which differ in particular in the differing configuration of the actuating lever or the lever mechanism of which the actuating lever is a part in order to be able to perform the respective characteristic movement of the furniture flap. The mechanical actuating unit is usually also always provided with a spring pack which serves to compensate for or calibrate for the weight of the furniture flap within certain limits.

As the furniture flaps differ by virtue of different configurations of the actuating lever or lever mechanism, fastening a single type of electric drive to mechanical actuating units for various flap types which are already mounted to the furniture carcass can be effected only with extreme difficulty, in particular as the various types of flap have different open positions and subsequent fastening of an electric drive is preferably to be effected in the open position of the furniture flap.

A possible alternative would be to develop a separate electric drive for each mechanical actuating unit which belongs to a special type of flap, that electric drive only matching that mechanical actuating unit. It will be appreciated however that that idea is to be rejected for economic reasons.

SUMMARY OF THE INVENTION

Therefore the object of the invention is to provide a furniture flap drive which includes an electric drive having an electric motor and a mechanical actuating unit having an actuating arm, wherein the electric drive and the actuating unit are in the form of separate components which can be fastened to each other. In that respect such fastening is to be made possible in a technically simple fashion, the electric drive being so designed that it can be fastened to actuating units for various types of furniture flap.

That object is attained by a furniture flap drive having the features of the present invention.

In that respect a furniture flap drive according to the invention includes a first component which has an electric motor and provides the drive force for moving the flap. A second component which is separate therefrom and which has an actuating arm, i.e. an adjustment arm and the first component can be releasably fastened together. The second component having the actuating arm represents a mechanical actuating unit, wherein there is a force storage means which acts on the actuating arm and which for example is in the form of a spring pack. The second component, that is to say the mechanical actuating unit, is mounted to the furniture carcass, in which case the first component can be fastened to the second component even when it is already mounted to the furniture carcass.

It will be appreciated that in principle it would also be conceivable for both components to be already fastened together prior to mounting to a furniture carcass. In that case the invention also serves to make the fastening operation easier, if only one kind of electric drive, that is to say only one kind of first component, is to be used for actuating units for different types of flap.

The actuating arm or the furniture flap of different types of furniture flaps cover travel paths of differing length between their two end positions (closed position of the furniture flap and the open position thereof). Thus for example the angular range which can be covered in the case of an upwardly foldable flap (UFF) is about 140°. In the case of an upwardly pivotable flap (UPF) the actuating arm can cover an angular range of about 150° while that angular range in the case of an upward lift flap (ULF) is about 160°. Those angles are each measured starting from that position at which the furniture flap bears against the furniture carcass (possibly while maintaining a slight gap in relation to the furniture carcass to permit touch-latch triggering) in the closed end position, that is to say in the closure position. Angle measurement can optionally also be effected starting from a notional straight line extending vertically through the pivot point of the actuating arm. The actual concrete numbers can change somewhat as a result.

Quite generally it will be appreciated that the precise angles can differ from each other depending on the respective manufacturer or it may be possible that other types of furniture flap with other angle ranges which can be covered are to be used. It is also conceivable that the three above-listed types of furniture flap (UFF, ULF, UPF) involve values different from those listed above for the angle range which can be covered.

If now the first component having the electric motor and the second component having the actuating arm are fastened to each other, wherein the second component is already mounted to the furniture carcass, it will be appreciated that this cannot be effected in the closure position of the furniture carcass but has to be effected in an opened position, preferably in the end position, that is to say in the completely open position of the furniture carcass. For that purpose the force transmission means for transmitting the drive energy has to be connected to the actuating arm or brought into engagement therewith. As however the position of the actuating arm in the open position differs according to the respective type of flap the position of the force transmission device also has to be altered to correspond to the type of flap. For that purpose according to the invention there is a positioning device with which the position of the force transmission device can be adjusted so that that position relates to the type of flap being used and is adjustable in such a way that the first component, that is to say the electric drive, can be fastened to the second component, that is to say the mechanical actuating unit, in different positions of the actuating arm.

In that case the first component can be fastened to the second component in at least two and preferably three different positions of the actuating arm. The position of the force transmission device can be moved into positions which are especially provided for that purpose. The three different types of furniture flap—upward lift flap, upwardly pivotable flap and upwardly foldable flap—can be taken into consideration by virtue of the three different positions of the force transmission device, wherein only one kind of electric drive, that is to say only one kind of the first component which includes the electric motor has to be produced for all those types of flap, wherein it can be fastened to the respective mechanical actuating unit after adjustment of the position of the force transmission device, by means of the positioning device.

In that respect it can be provided that the adjustment in the position of the force transmission device is possible discretely or steplessly. The discrete positions of the force transmission device correspond in that case to the various types of furniture flaps to which the first component according to the invention can be fastened. Upon stepless adjustment of the position of the force transmission device it can further be provided that the force transmission device latches in different discrete steps or different positions can be felt during the adjustment in position of the force transmission device, wherein once again the various discrete steps correspond to the different types of flap.

After the first component having the electric drive has been fastened to the second component having the actuating arm the actuating arm can be moved or driven by the force transmission device for closing and opening the flap. It will be appreciated that this movement of the force transmission device is to be viewed independently of the change in position for fastening the two components together and naturally is effected steplessly.

Further advantageous configurations of the invention are defined in the appendant claims.

It is preferably provided in that respect that the various positions of the force transmission device correspond to various angular positions of the actuating arm, wherein the different angular positions preferably correspond to the open position of the furniture flap.

In a particularly preferred embodiment the force transmission device is arranged on the first component while the second component has an interface with which the force transmission device can be brought into engagement. In that respect it can be provided that, by virtue of fastening the electric drive to the actuating unit, the interface produces so-to-speak automatically a connection for force transmission between the electric drive and the actuating unit. In an embodiment of the invention the force transmission device can be in the form of a pin, wherein the force transmission device and in particular the pin can be arranged on an eccentric transmission which is operatively connected to a drive output of the electric motor and is therefore driven to move the furniture flap by the electric motor. Preferably the interface is in the form of a receiving opening on the actuating unit, in which case the force transmission device and in particular the pin can engage into that opening.

In an embodiment of the invention it is provided that the positioning device has at least one abutment element with which the force transmission device is movable. It is preferably provided in that respect that the force transmission device is displaceably movable by the abutment element.

So that the positioning device can adjust or displace the position of the force transmission device according to the type of furniture flap used, it can be provided that the positioning device has at least one and preferably two actuating elements.

After the first component having the electric motor and the second component having the actuating arm have been fastened together naturally unwanted release of that connection, that is to say detachment of the first component from the second component, is to be avoided as much as possible. For that purpose in a particularly preferred embodiment of the invention there is provided at least one locking element which can preferably equally be actuated by the positioning device and with which the two components can be fixed or locked to each other.

In an embodiment of the invention the at least one locking element is arranged on the positioning device and is for example in the form of a hooked projection, wherein the locking element and preferably the hooked projection can be brought into engagement at an abutment element arranged in or on the second component.

In a further embodiment of the invention there is provided an indicator device with which fastening of the first component to the second component can be indicated. In that respect it may be preferable if the indicator device indicates not only fastening but locking of the first component to the second component.

It is particularly preferred if the indicator device is actuable by the at least one locking element. The indicator device itself can be of a resilient nature or can be spring-loaded.

The invention further concerns an article of furniture comprising a furniture carcass and a flap mounted movably to the furniture carcass, wherein a furniture flap drive according to the invention is arranged on one or both sides of the furniture carcass and the actuating arm of the furniture flap drive is connected to the flap.

In that respect it can be further provided that a mechanical actuating unit with force storage means and actuating arm, that is to say a second component, is admittedly arranged at both sides, but only one of those actuating units is connected to a first component according to the invention, that is to say an electric drive.

BRIEF DESCRIPTION OF THE DRAWINGS

Further details and advantages of the present invention are described more fully hereinafter by means of the specific description with reference to the drawings in which.

DETAILED DESCRIPTION OF THE INVENTION

Figure 1A:
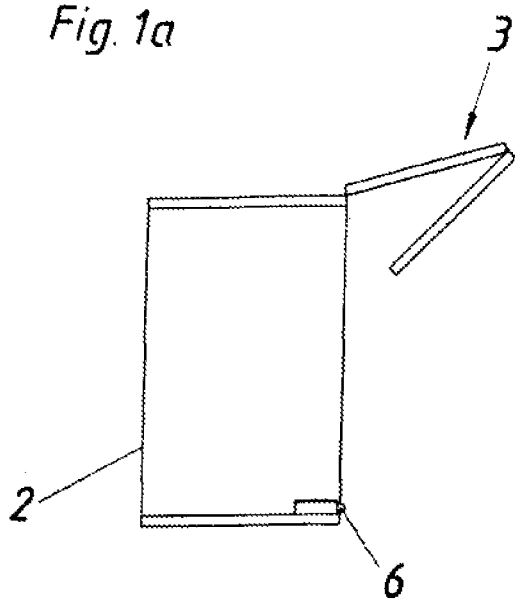
FIGS. 1*a* through 1*c* show by way of example three different types of furniture flap.
Figure 1B:
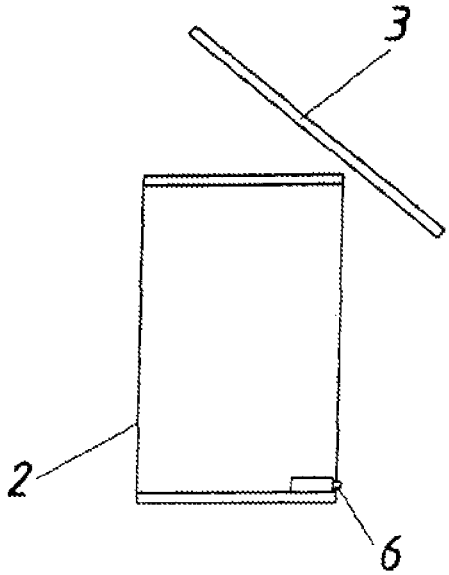
Figure 1C:
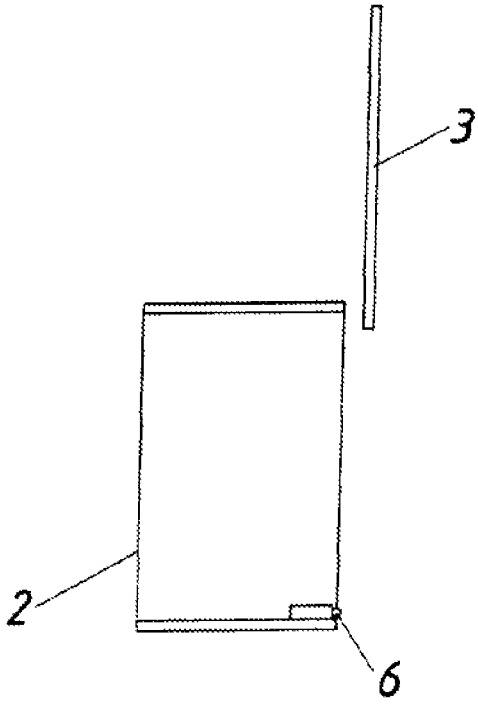
Figure 2A:
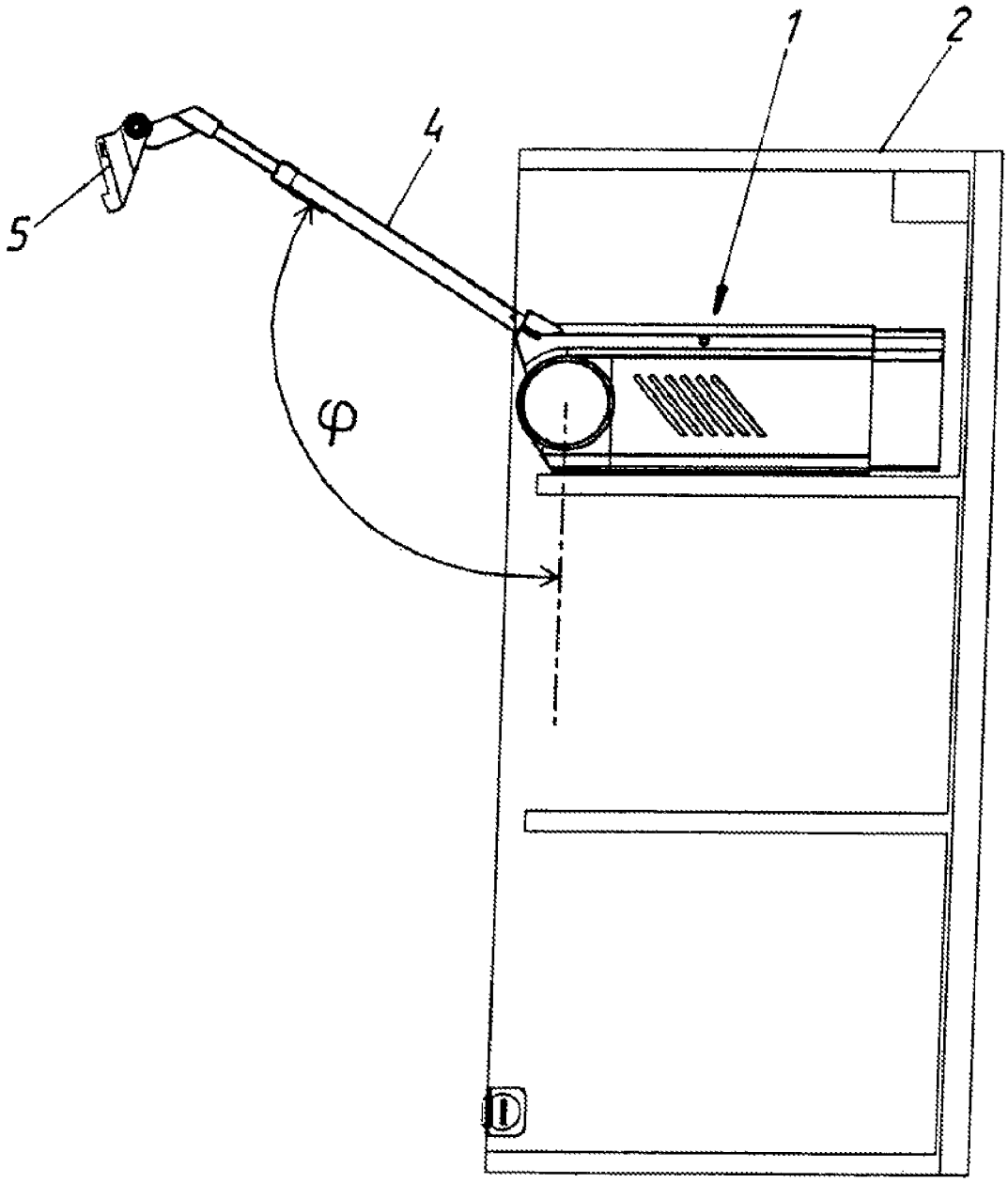
FIGS. 2*a* through 2*c* show the configuration of the furniture flap drive for each of the types of furniture flap shown in FIGS. 1*b* through 1*c*, FIGS. 3*a* through 3*c* show side views of three second components of differing configurations for moving different types of furniture flap.
Figure 2B:
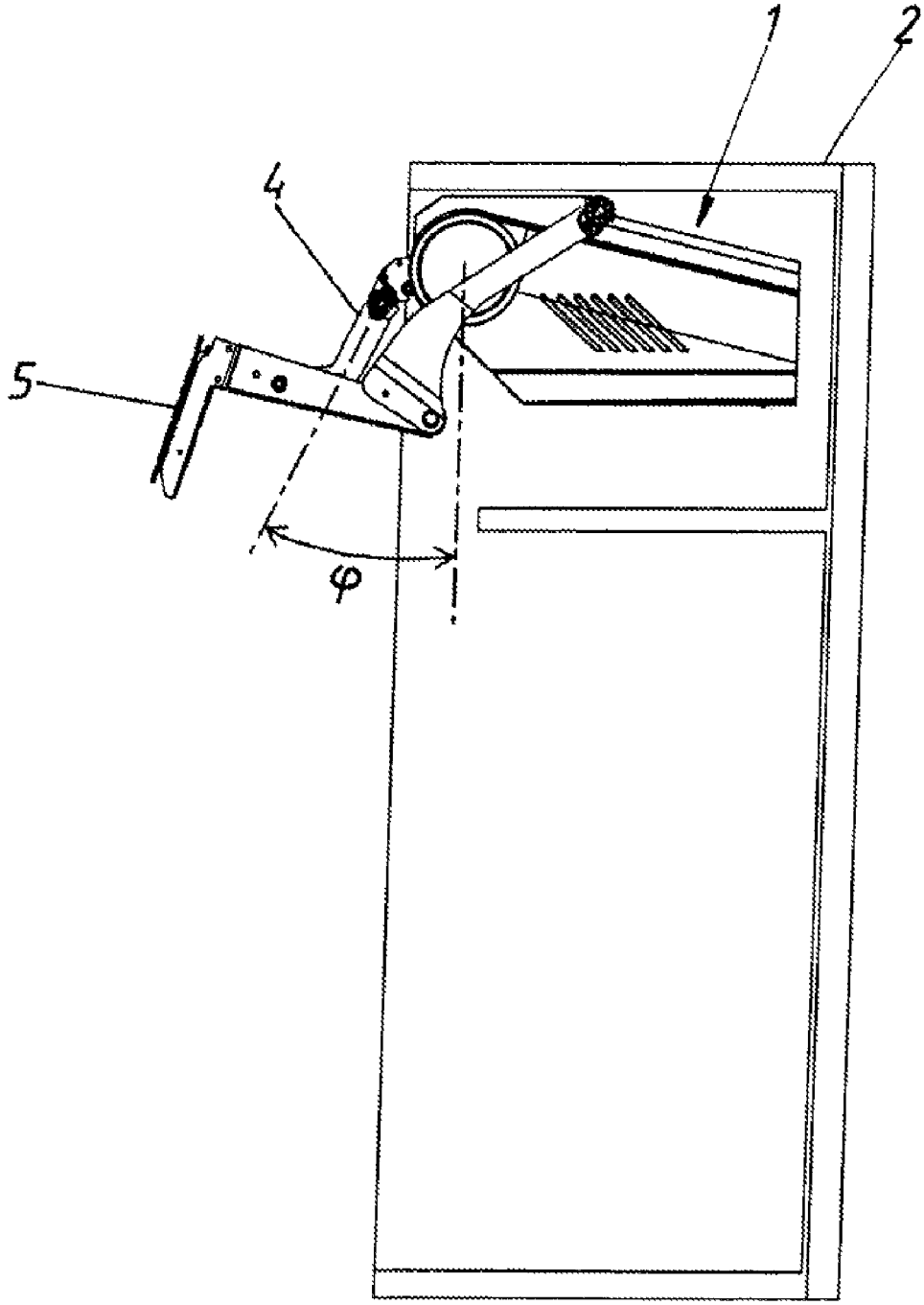
Figure 2C:
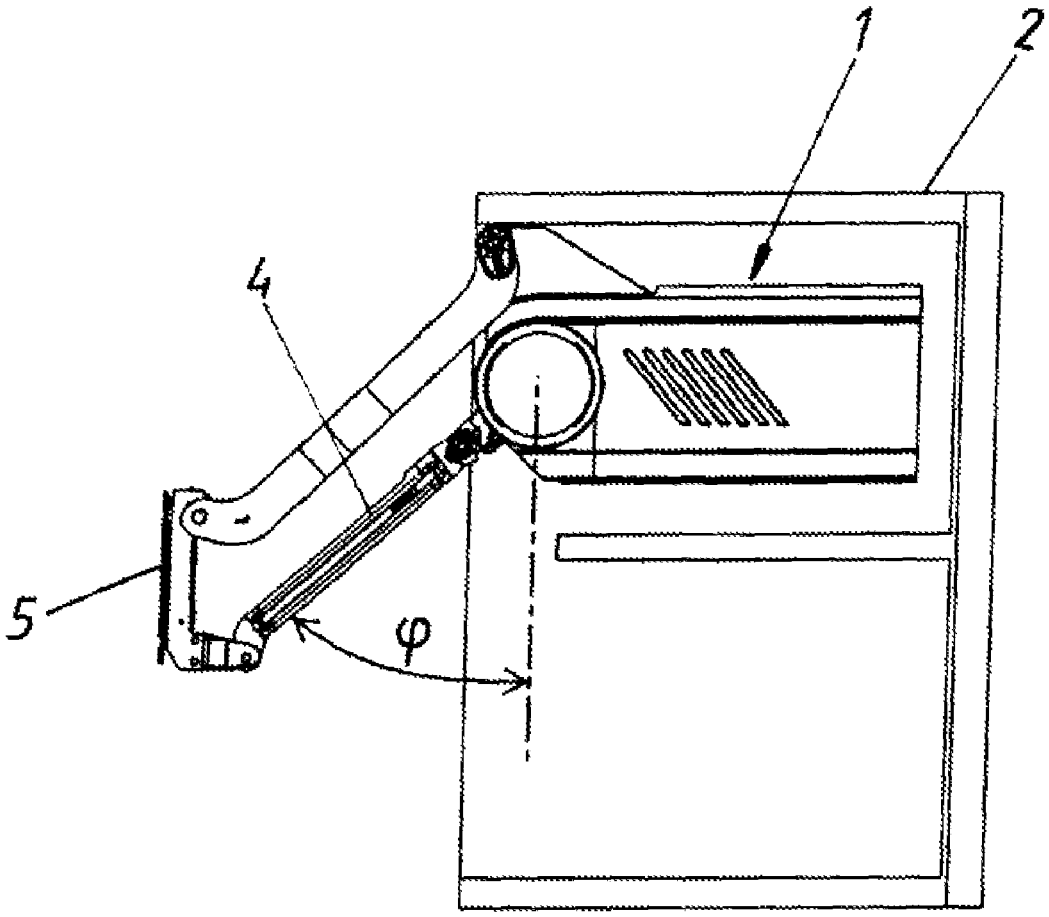

FIG. 1*a* shows a furniture flap 3 mounted movably on a furniture carcass 2, in the form of an upwardly foldable flap (UFF). The corresponding configuration of the furniture flap drive 1 is shown in FIG. 2*a*. The furniture flap drive 1 corresponds to the state of the art. The angle $\phi$ is measured in this case between two notional straight lines of which one extends parallel to the longitudinal extent of the actuating arm, i.e. the adjustment arm 4. The second straight line extends at least approximately vertically and through the pivot point of the actuating arm 4. The furniture flap 3 shown in FIG. 1*a* can be fastened to the plate 5. FIGS. 1*b* and 2*b* respectively show the corresponding views for an upwardly pivotable flap (UPF). FIGS. 1*c* and 2*c* respectively show the corresponding views of an upward lift flap (ULF).

It will be seen that the precise structure of the lever mechanism is different by virtue of the different, respectively required geometrical movement characteristics of the furniture flap 3. In each case however electric-motor driving of the movement of the furniture flap 3 is effected by the actuating arm 4 moved by means of a force transmission device 11. The furniture flap drive 1 includes in each case the two components 7, 8 which can be releasably fastened to each other. The electric motor and the corresponding electronic circuits are in that case arranged in the first component 7 representing the electric drive. The force storage means which acts on the actuating arm 4 and which is mostly in the form of a spring pack is disposed in the second component 8.

Figure 3A:
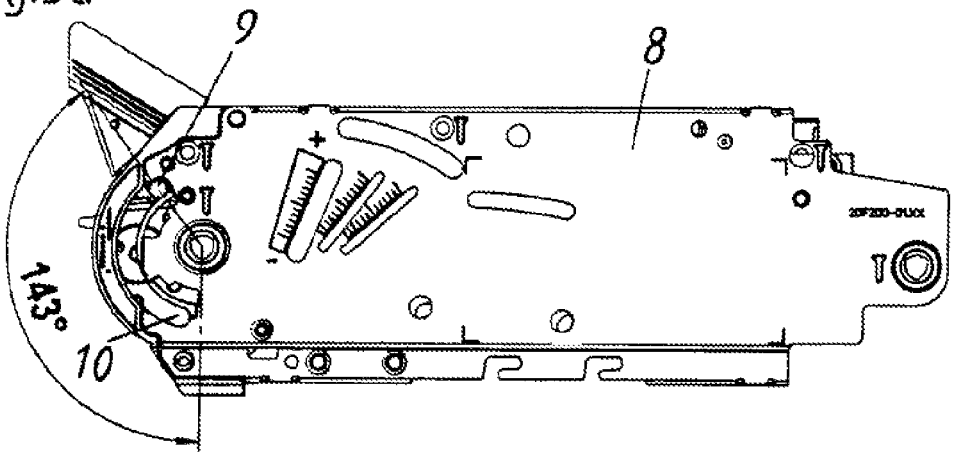
Figure 3B:
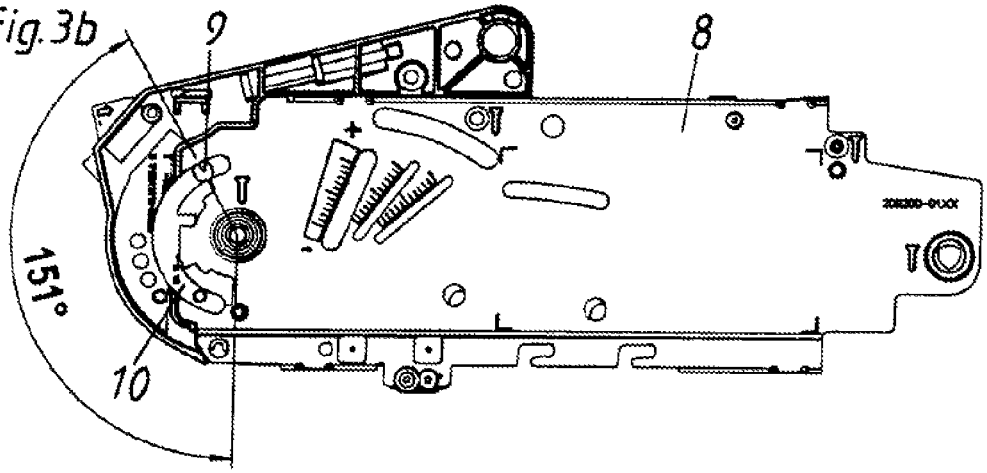
Figure 3C:
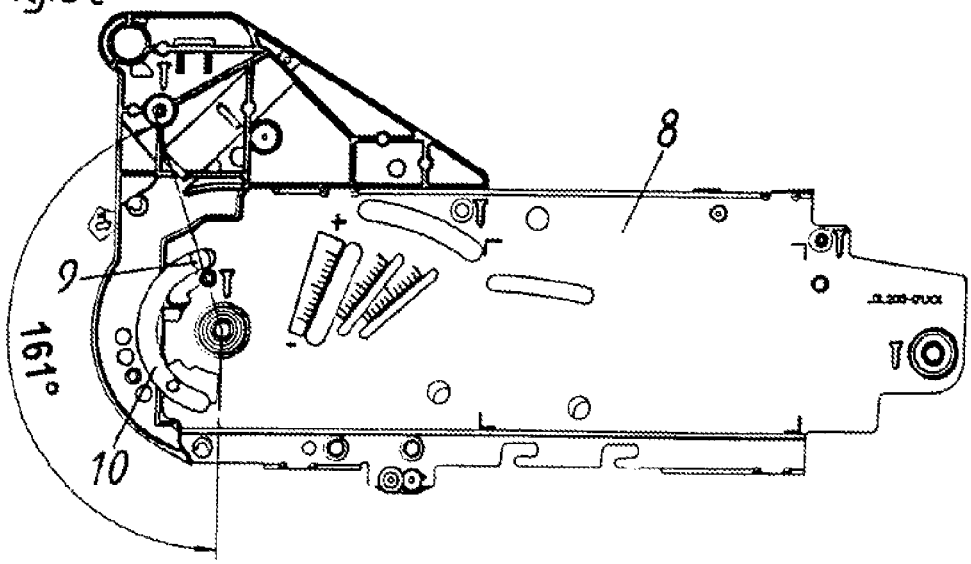

FIGS. 3*a* through 3*c* respectively show a side view of an embodiment of a second component 8 (mechanical actuating unit). Depending on which type of furniture flap is to be used, a corresponding second component 8 is employed.

FIG. 3*a* shows a mechanical actuating unit 8 for an upwardly foldable flap. The angle range which can be covered from the closure position to the open position of the furniture flap 3 is 143° in this embodiment. The interface 9 which in the form of a receiving opening in the actuating arm 4 is disposed in that position in which the furniture flap 3 or the actuating arm 4 is in the open position. The force transmission device 11 can be brought into engagement with the interface 9. For the opening and closing movement of the actuating arm 4 the interface 9 and the force transmission device 11 move along the guide path 10.

The second component 8 in FIG. 3*b* serves for movement of an upwardly pivotable flap (UPF). The angle range which can be covered in this embodiment is 151°. The interface 9 which is in the form of a receiving opening in the actuating arm 4 is in that position in which the furniture flap 3 or the actuating arm 4 is in the open position. Once again the force transmission device 11 of the first component 7 can be brought into engagement with the interface 9 and both are moved during the opening or closing movement, along the guide path 10.

FIG. 3*c* shows a second component 8 for moving an upward lift flap (ULF). In this embodiment the angle range which can be moved is 161°. Once again the interface 9 which is in the form of a receiving opening is in that position in which the furniture flap 3 is in its open position. The force transmission device 11 is brought into engagement with the interface 9. Both move along the guide path 10 during the opening and closing movement.

The difficulty in fastening the first component 7 to the second component 8 if only one kind of first component 7 is to be used for different design configurations of the second components 8, can be seen by reference to FIGS. 3*a* through 3*c*. If the second component 8 is already fastened to the respective furniture carcass 2 and the first component 7 is subsequently fastened to the second component 8, that is preferably effected in the open position of the furniture flap 3. In the open position however the interface 9 is at different opening angles $\phi$, whereby the position of the force transmission device 11 has to be suitably adapted. That positional adaptation is effected with a positioning device 12 according to the invention.

Figure 4:
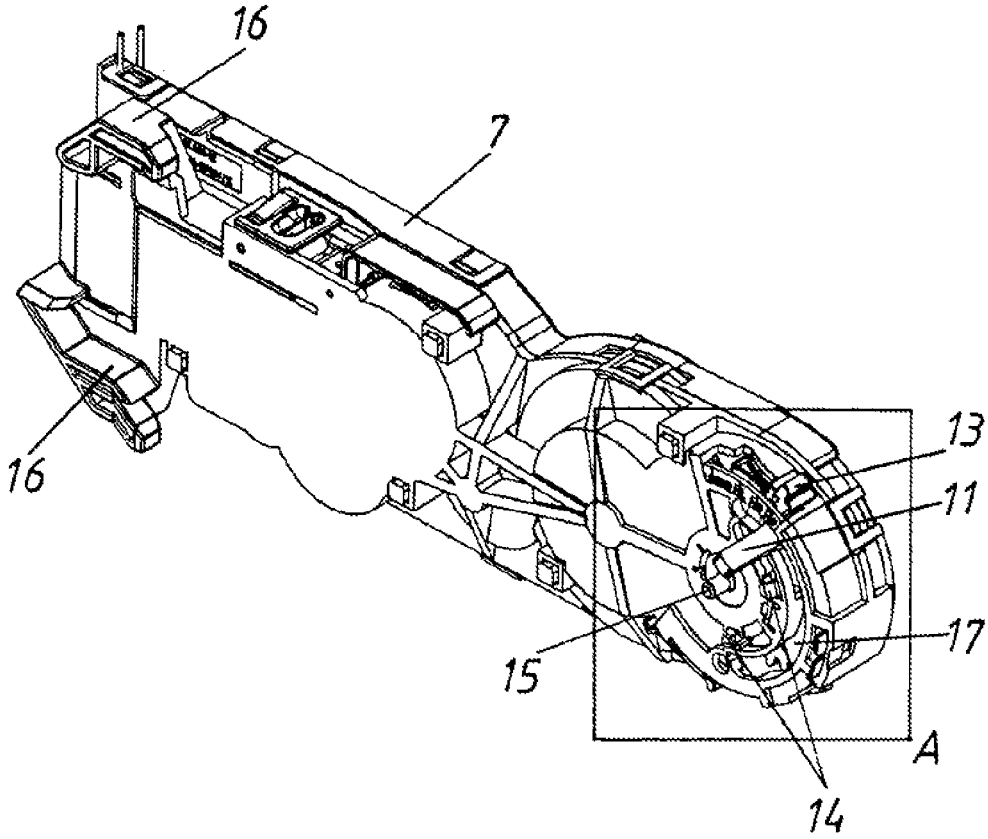
FIG. 4 shows a perspective view of an embodiment of a first component which can be fastened to the second components which are shown in FIGS. 3*a* through 3*c* and which are of a different configuration.

A perspective view in FIG. 4 shows a first component 7, that is to say an electric drive, which can be releasably fastened to various configurations of the second component 8. In that respect, besides a centering pin 15 which can be pushed into an associated receiving opening 26 in the second component 8, two holding noses 16 serve for releasable fixing, the noses 16 bearing against corresponding surfaces of the second component 8. Those surfaces serve as abutment elements or holding elements. The first component 7 has the force transmission device 11 which is inserted into the interface 9 in the form of the receiving opening and thereby brought into engagement. The positioning device 12 is provided with an actuating element 13 with which the force transmission device 11 is movable. The force transmission device 11 is partially displaced along a receiving opening 17 in the housing of the first component 7 by actuation of the actuating element 13, by the positioning device 12. Hooked projections serve as locking elements 14 for fixing or locking the fastened components 7, 8.

Figure 5:
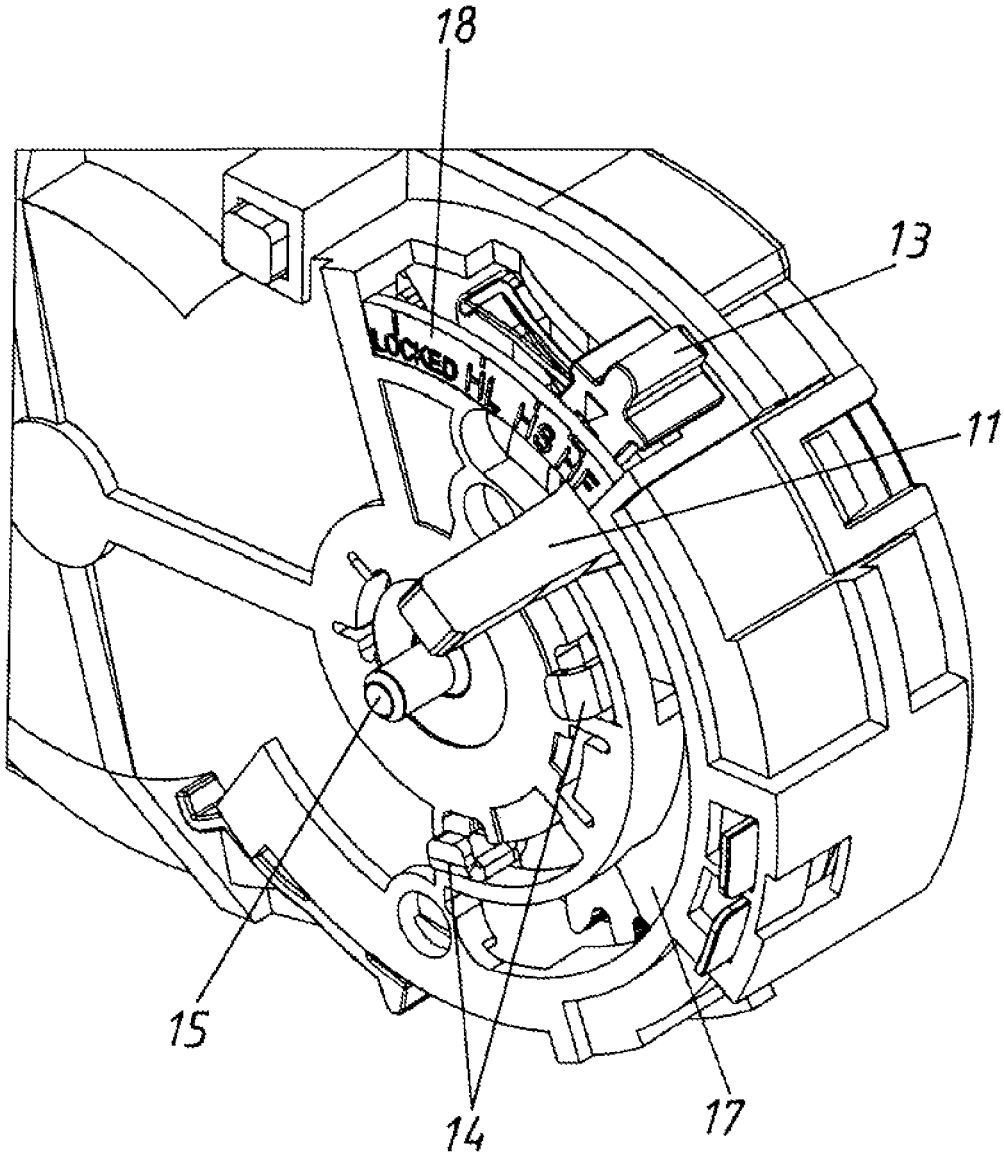
FIG. 5 shows a detail view of the portion marked with A in FIG. 4.

FIG. 5 shows a perspective view of the portion marked with A in FIG. 4. In this case the actuating element 13 can be displaced to different positions. Those positions are marked on a surface 18 ("HL" denoting ULF, "HF" denoting UFF and "HS" denoting UPF) and identify the various type of flap. The force transmission device 11 is also displaced by displacement of the actuating element 13, the force transmission device 11 being partially displaced along the opening 17.

For mounting to an upwardly foldable flap (UFF) the actuating element 13 and therewith the force transmission device 11 is displaced furthest along the receiving opening 17 as that type of flap involves the smallest opening angle $\phi$ of the three illustrated types of flap. To close the upwardly foldable flap the force transmission device 11 is moved from that starting point, that is to say from the position marked with "HF", downwardly along the receiving opening 17 and in so doing entrains the actuating arm 4.

The upward lift flap involves the largest opening angle $\phi$ so that, for fastening the first component 7 to the second component 8, the force transmission device 11 must be displaced in this case least along the guide path 17. To close the upward lift flap the force transmission device 11 is moved with the actuating arm 4 from that starting point, that is to say from the position marked by "HL", downwardly along the receiving opening 17.

Disposed therebetween is the marking for the upwardly pivotable flap. To close the upwardly pivotable flap the force transmission device 11 is moved with the actuating arm 4 from that starting position, that is to say from the position marked by "HS", downwardly along the receiving opening 17.

When now the first component 7 is fastened to the second component 8 the actuating element is previously manually set to the respective type of flap. In that respect it can be provided that the positioning device 12 or the actuating element 13 comes into latching engagement at the respective position or that position can be felt in the displacement movement. With that displacement the force transmission device 11 is displaced in such a way that it can be pushed into the interface 9 in the form of the receiving opening at the second component 8 which is possibly already fitted.

After fastening of the two components 7, 8 to each other the actuating element 13 can be displaced to a further position. That position is identified by "LOCKED" on the marking surface 18. Two locking elements 14 which are in the form of hooked projections on the positioning device 12 are displaced by a displacement of the actuating element 13 to that position, to a position at which they come into engagement with abutment or holding elements 25 provided for that purpose on the second component 8. In that way the two components 7, 8 can no longer be released from each other because detachment of the first component 7 from the second component 8 is prevented by the locking elements 14 and the abutment or holding elements 25. It is only when the actuating element 13 is removed from the "LOCKED" position again that release is possible.

Figure 6:
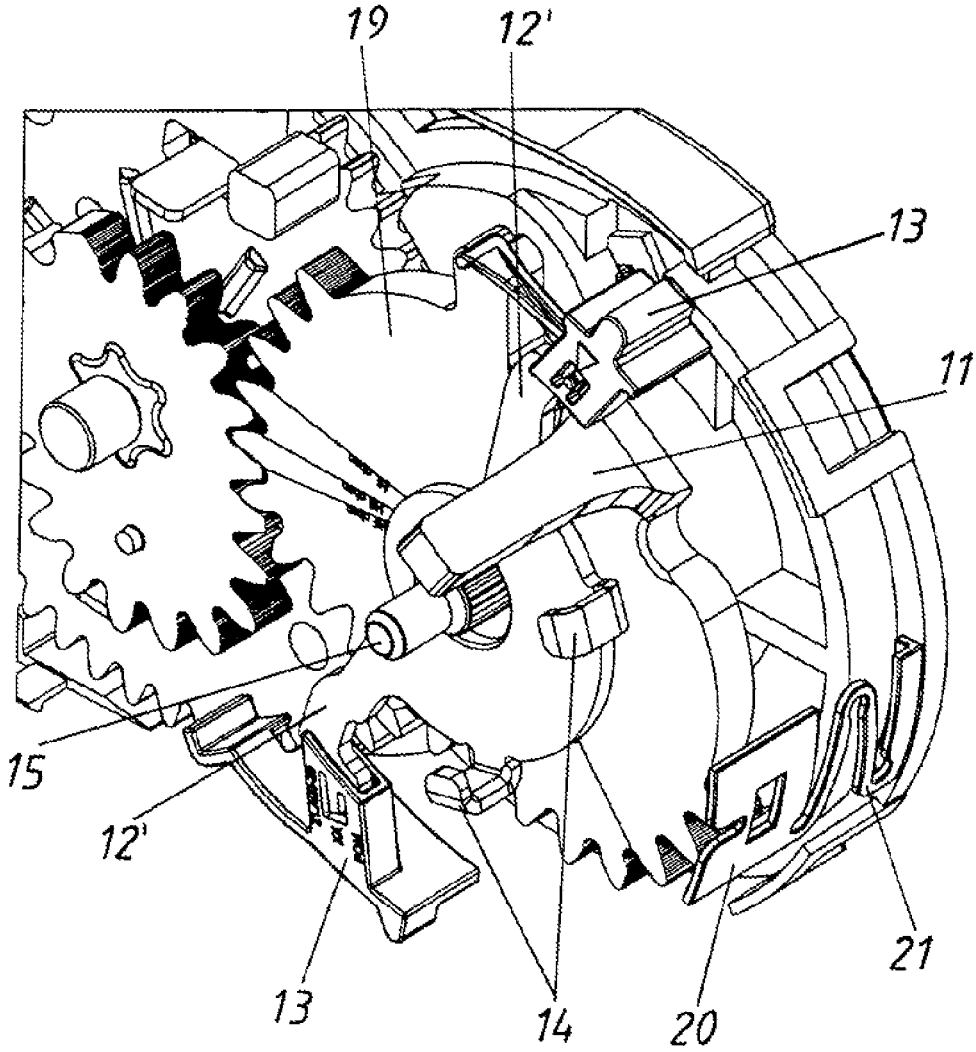
FIG. 6 shows a partly broken-away view of FIG. 5.

The partly broken-away perspective view in FIG. 6 shows the positioning device 12 which has two mutually opposite actuating elements 13. The positioning device 12 is rotated by displacement of the actuating elements 13, whereby abutment elements 12' are displaced and thereby displaceably move the force transmission device 11. The force transmission device 11 in turn is arranged on an eccentric transmission gear 19. Locking elements 14 in the form of hooked projections are arranged on the positioning device 12. An indicator device 20 acted upon by a spring 21 serves to indicate whether the two components 7, 8 are correctly fastened together or locked.

Figure 7:
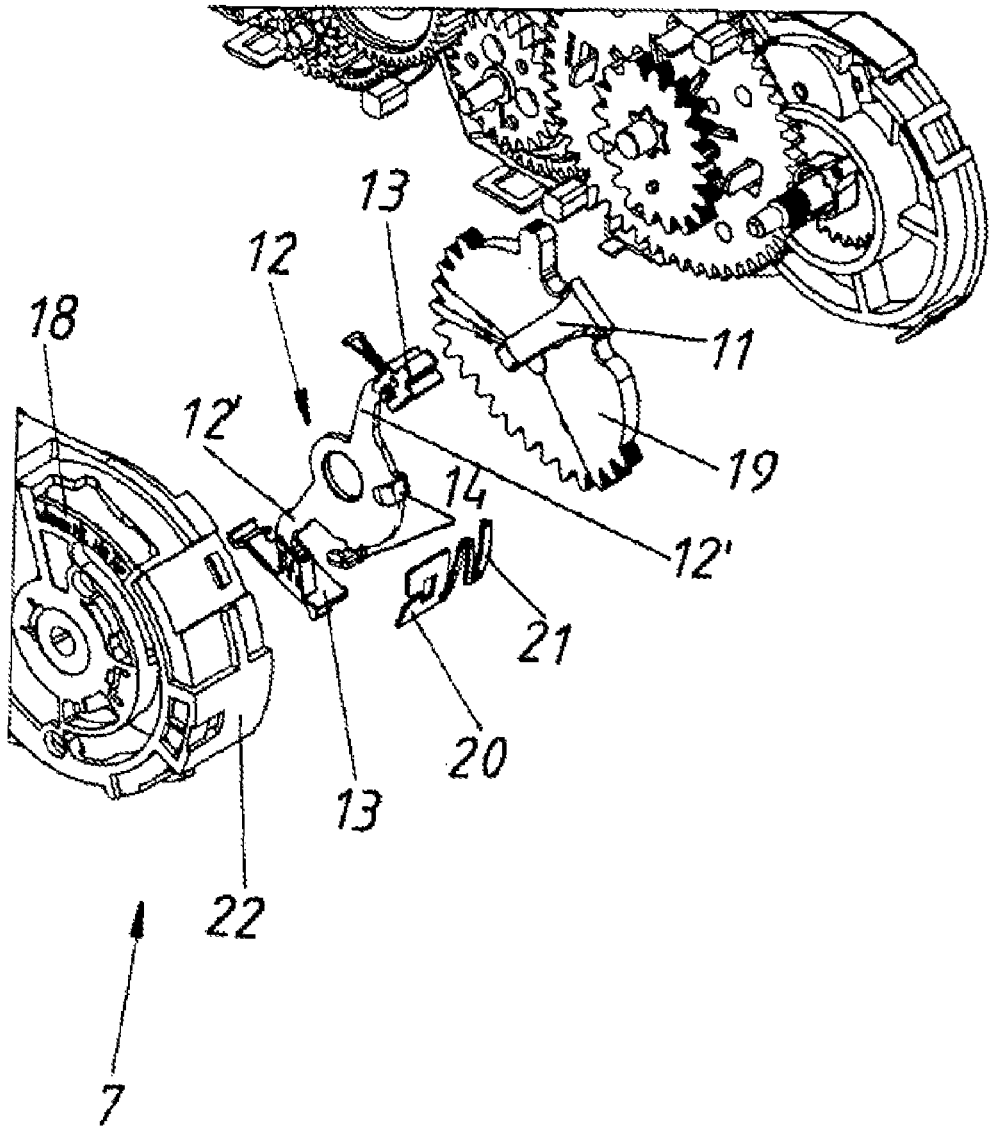
FIG. 7 shows an exploded view of the components which are essential for the invention, of the first component.

The exploded view in FIG. 7 shows once again the essential components 7, 8 of the invention. The force transmission device 11 is arranged on the eccentric transmission gear 19. The positioning device 12 has abutment elements 12' which are displaced by actuation of the actuating elements 13 and in so doing also displace the force transmission device 11. The markings for the corresponding types of flap are disposed on the housing 22 of the first component 7.

Figure 8A:
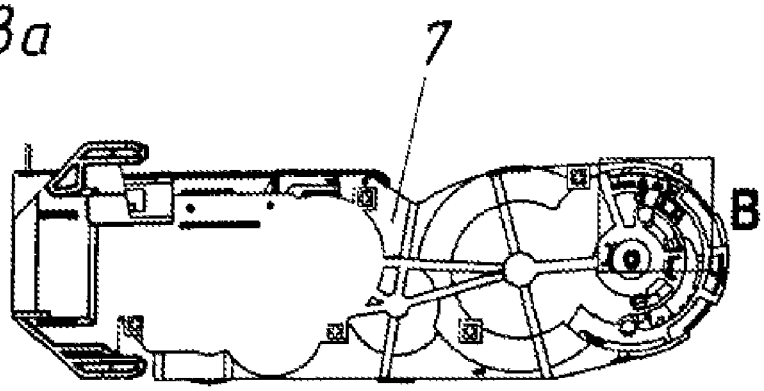
FIGS. 8*a* and 8*b* show a side view of an embodiment of a first component and a detail view of the portion marked with B in FIG. 8*a*, wherein the positioning device is adjusted for a specific type of flap.
Figure 8B:
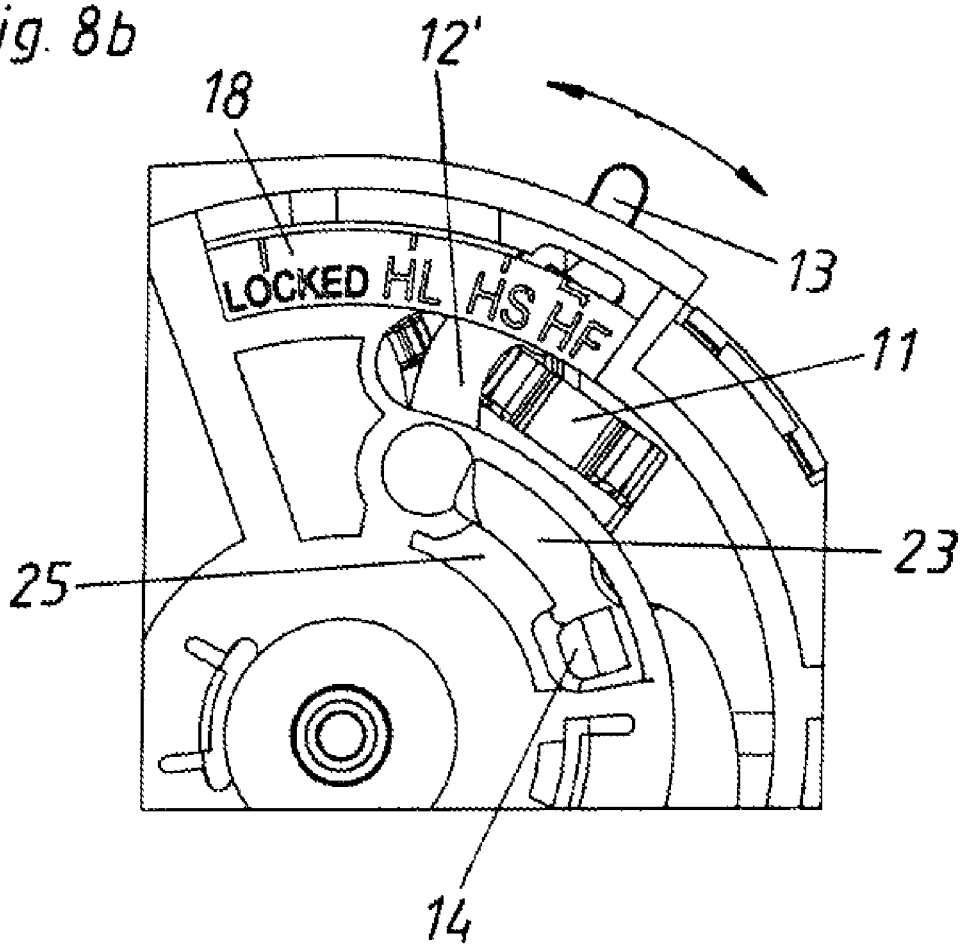

The detail view in FIG. 8*b* of the portion marked with B in FIG. 8*a*, showing a side view of an embodiment of the first component 7, illustrates how the actuating element 13 of the positioning device 12 is arranged in the position marked for the upwardly foldable flap. In this case the abutment element 12' of the positioning device 12 has displaced the force transmission device 11 into a suitable position. The locking element 14 is arranged in a receiving opening 23 in the housing 22.

Figure 9A:
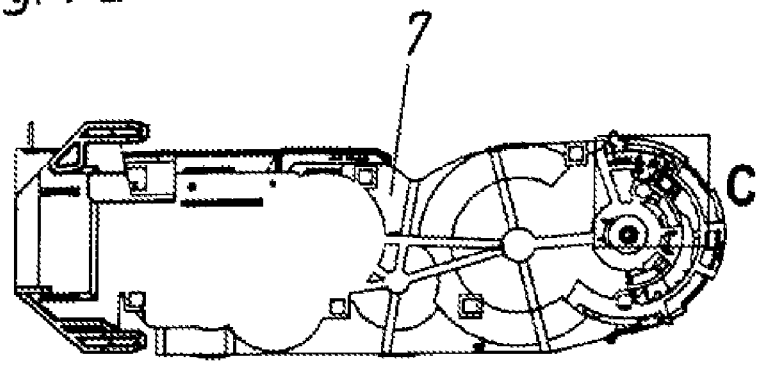
FIGS. 9*a* and 9*b* show the embodiment of the first component of FIG. 8*a*, wherein the positioning device is adjusted in the locking position and a detail view of the portion marked with C in FIG. 9*a*.
Figure 9B:
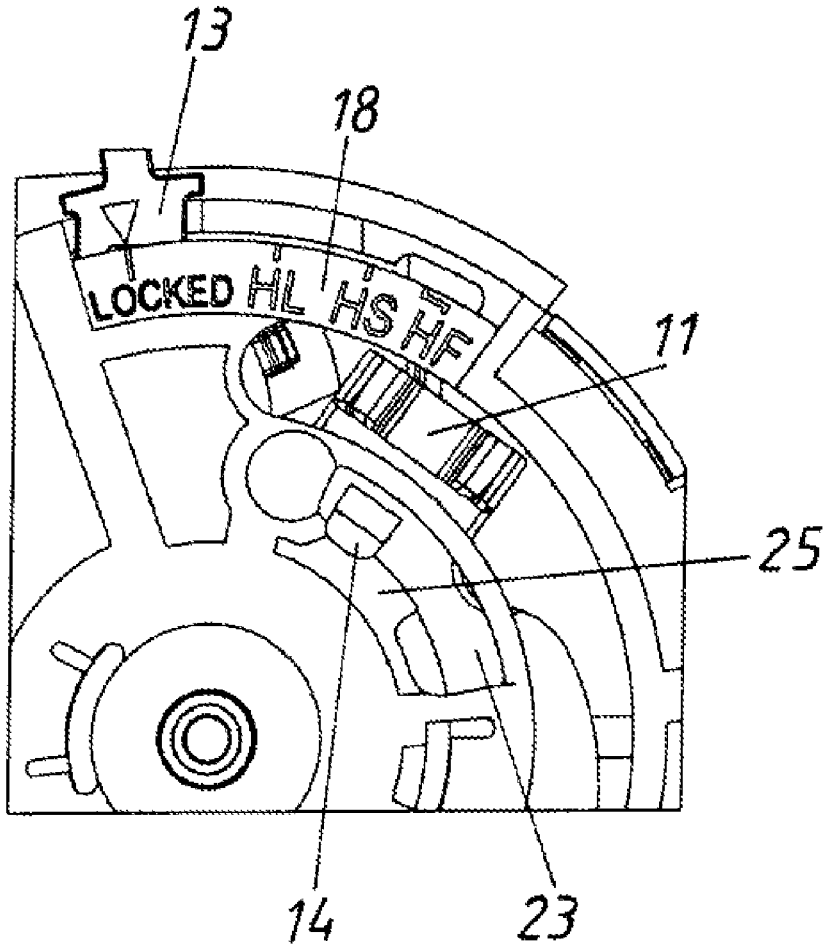

When the two components 7 and 8 are now fastened together the actuating element 13 is displaced to the position marked with "LOCKED", as shown in the detail view in FIG. 9*b* of the portion marked with C in FIG. 9*a*. The positioning device 12 and therewith the locking elements 14 are rotated by that displacement of the actuating element 13 whereby they have been brought into engagement with corresponding abutment or holding elements 25 of the second component 8.

Figure 10:
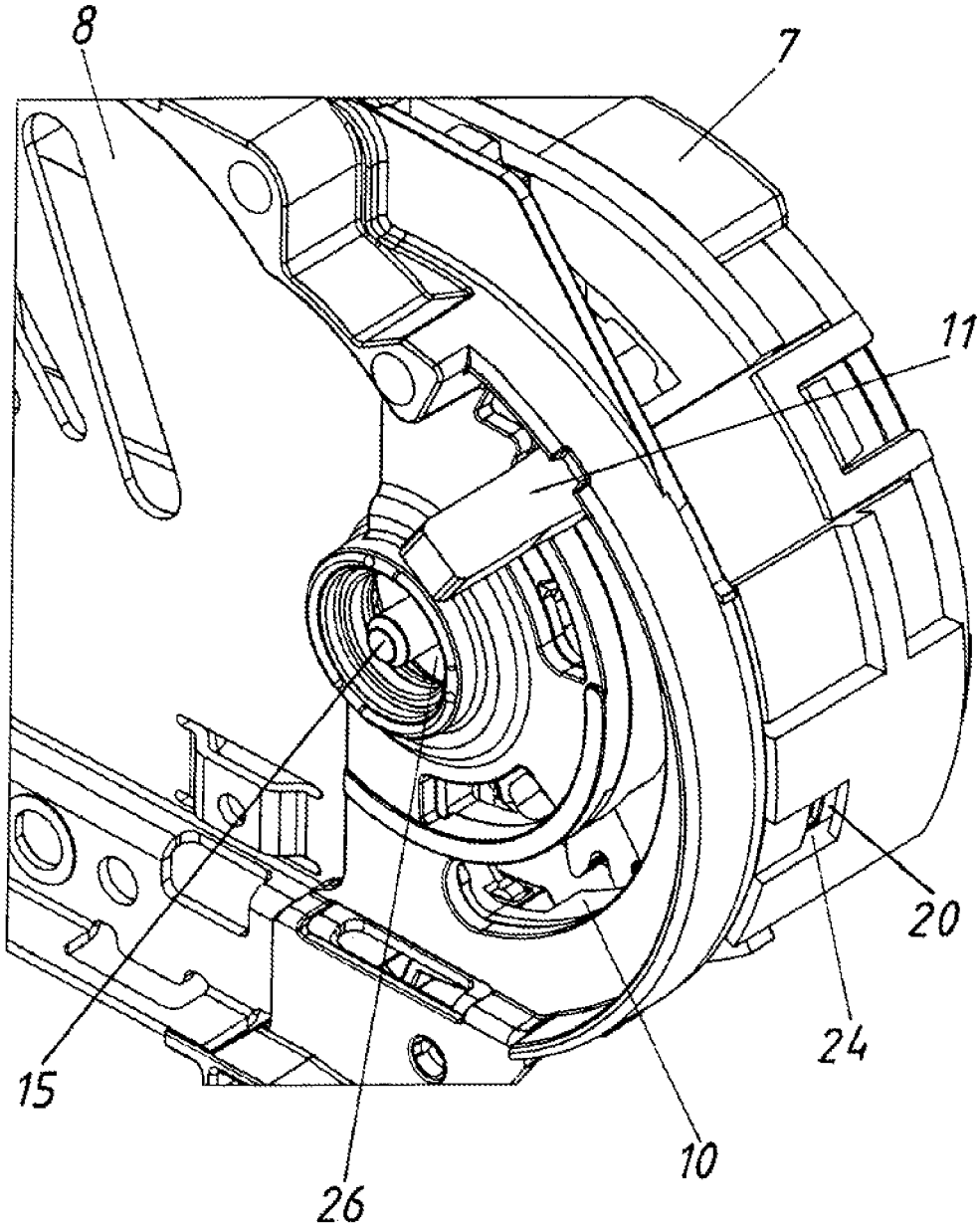
FIG. 10 shows a perspective detail view of the first and second components in the condition of being fastened to each other.

FIG. 10 shows a perspective detail view of the components 7 and 8 fastened together. It shows how the force transmission device 11 which is in the form of a pin has been inserted into the interface 9 in the form of the receiving opening and has thereby come into engagement therewith. The electric motor now moves the force transmission device 11 along the guide path 10 whereby the actuating arm 4 is correspondingly moved. The indicator device 20 can be seen in a receiving opening 24 in the housing, indicating whether the components 7 and 8 are correctly fastened together or locked.

Figure 11A:
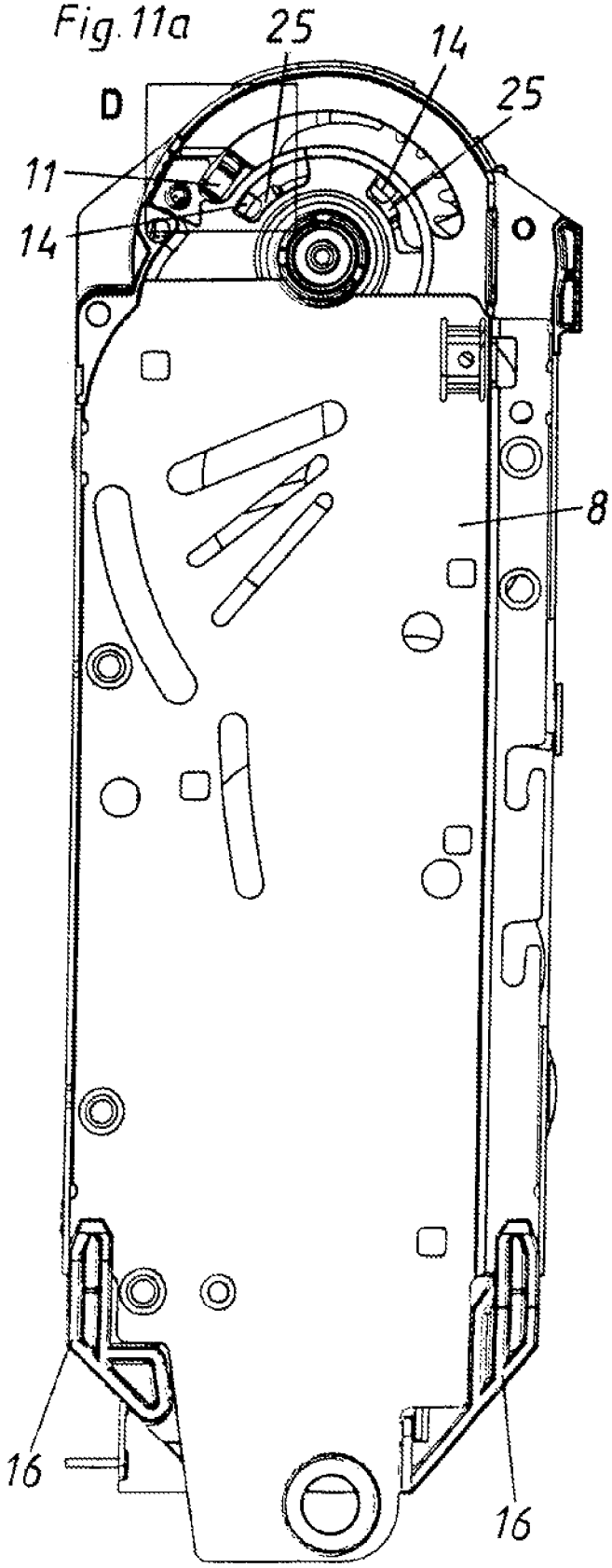
FIGS. 11*a* through 11*c* show a side view and a front view of an embodiment of the first and second components in the state of being fastened to each other and a detail view of the portion marked with D in FIG. 11*a*, FIGS. 12*a* and 12*b* show a perspective view and a plan view of an embodiment of the first and second components in the state of not yet being fastened together.
Figure 11B:
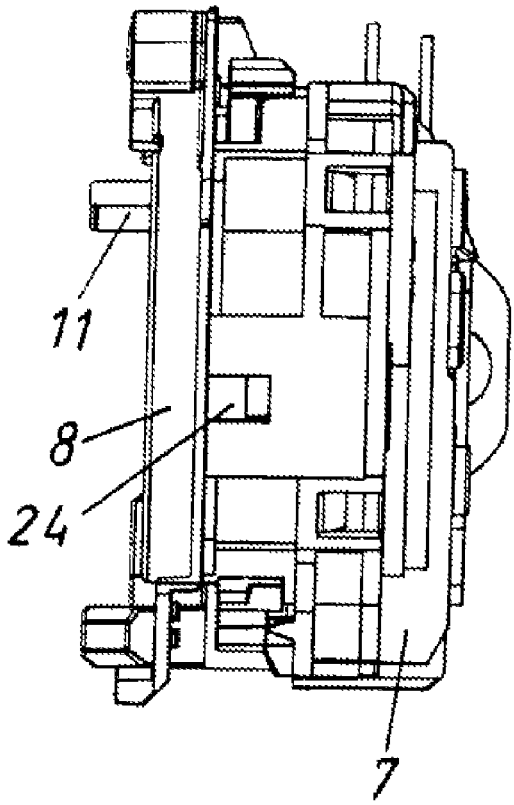
Figure 11C:
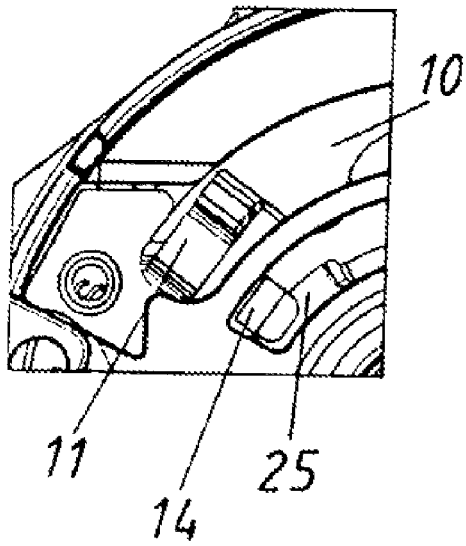
Figure 12A:
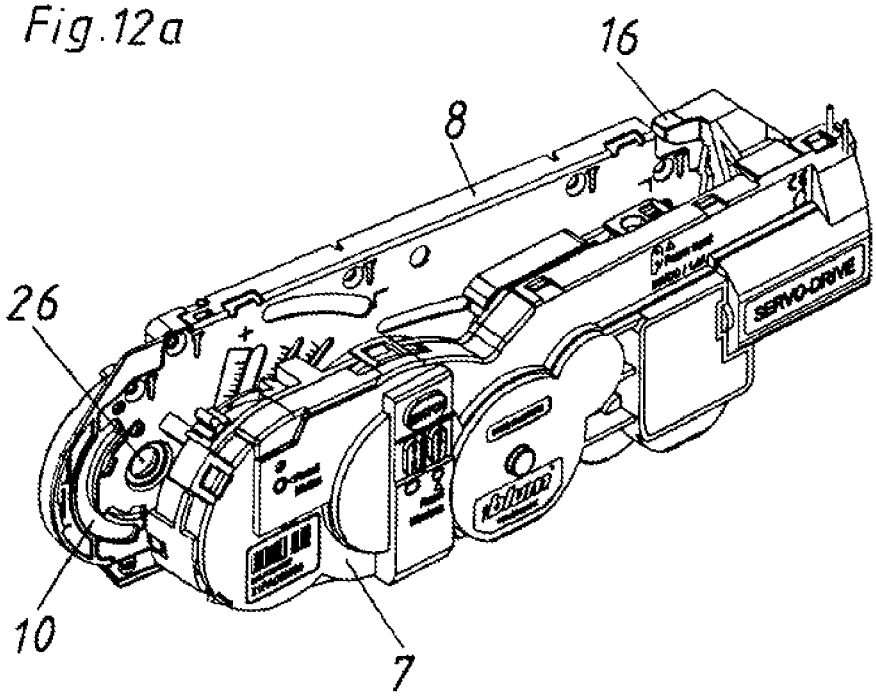
Figure 12B:
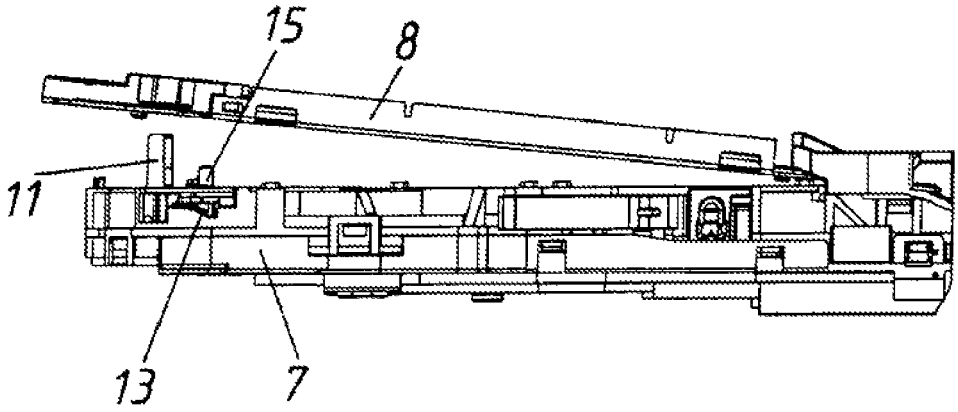

FIGS. 11*a* through 11*c* again show the components 7 and 8 fastened together. As can be seen the locking elements 14 are in engagement with corresponding abutment or holding elements 25. The force transmission device 11 is also in engagement with the interface 9.

The perspective view 12*a* and the plan view 12*b* show how the two components 7 and 8 are fastened together after the positioning device 12, by means of the actuating element 13, has displaced the force transmission device 11 into the corresponding position for the respective type of flap. The first component 7 is engaged into the second component 8 by means of the holding nose 16. Those surfaces or edges of the second component 8, at which the holding noses come to bear, serve as a bearing about which the engaged first component 7 can be pivoted towards the second component 8. The centering pin 15 can be inserted into the opening 26 in the second component 8. That connection serves for play-free positioning of the components 7, 8.

Figure 13A:
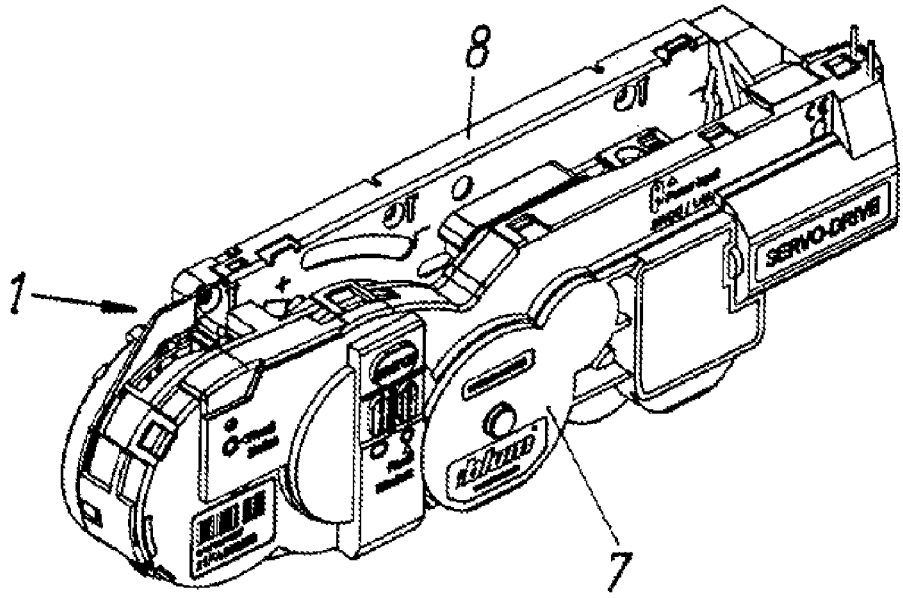
FIGS. 13*a* and 13*b* show the components of FIG. 12 in the state of being fastened together, and FIGS. 14*a* and 14*b* each show a perspective view of a furniture carcass with a mounted furniture flap drive for a specific type of furniture flap.
Figure 13B:
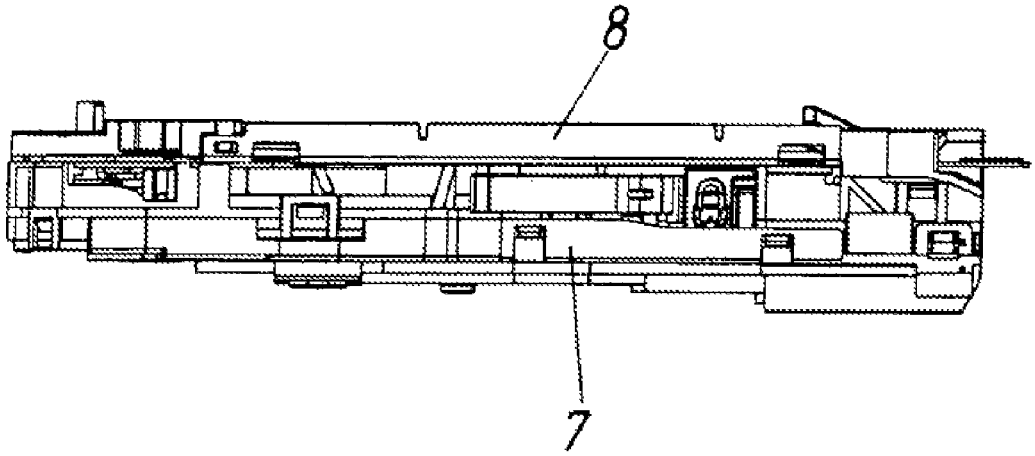

The positioning device 12 together with the locking elements 14 and the associated abutment or holding elements 25 serve as a locking device which is remote from the bearing and by means of which the first component 7 can be preferably releasably locked to the second component 8. That condition is shown in FIGS. 13*a* and 13*b*.

Figure 14A:
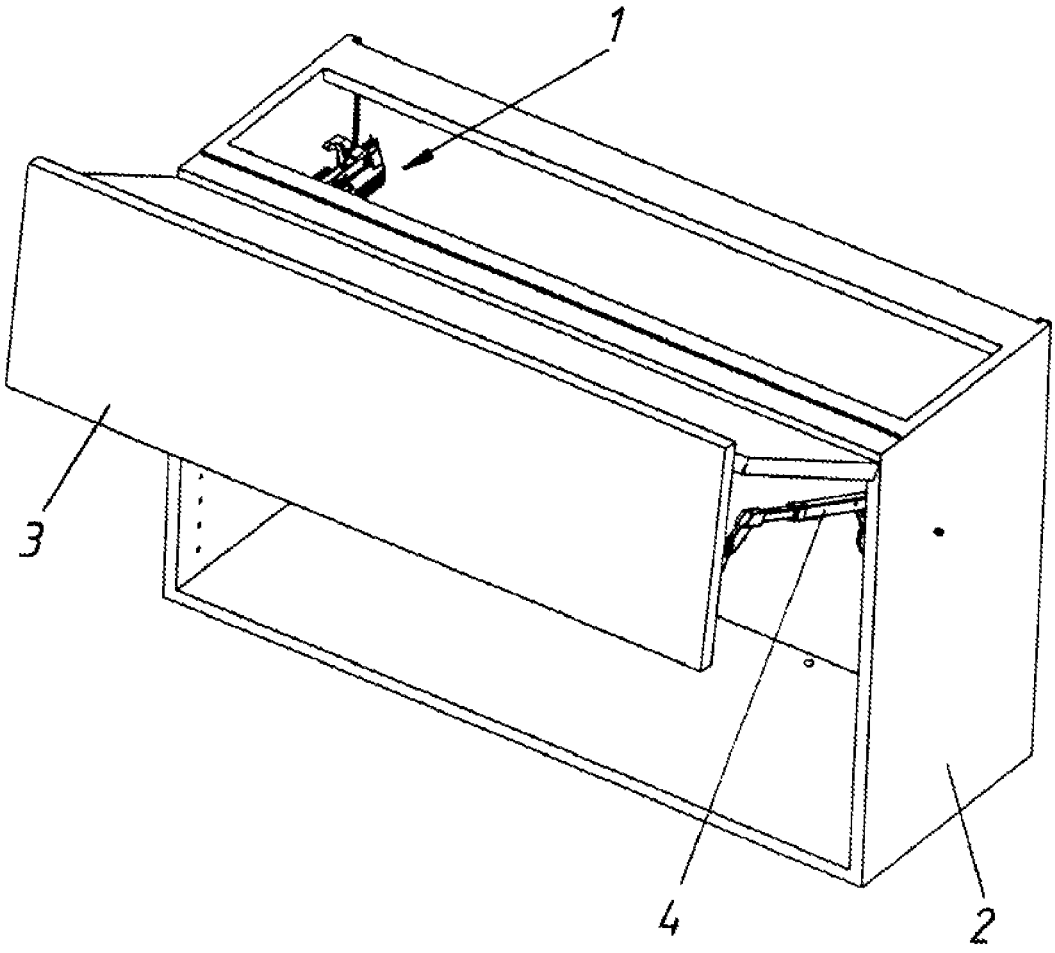
Figure 14B:
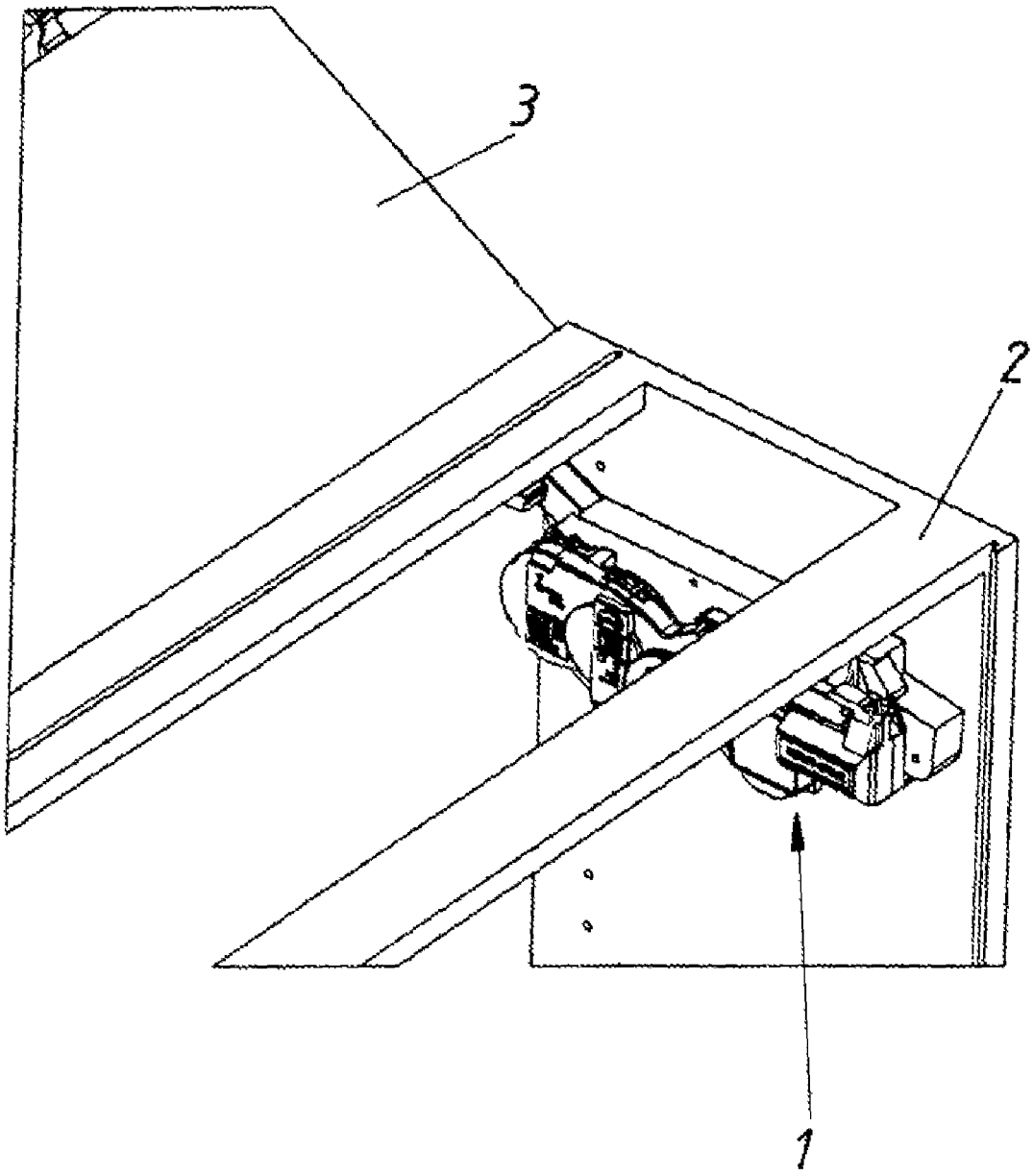

FIG. 14*a* shows a furniture carcass 2 with a furniture flap 3 mounted movably thereto, in the form of an upwardly foldable flap, and a furniture flap drive 1 as shown in FIGS. 3 through 13. FIG. 14*b* shows a perspective detail view of FIG. 14*a* viewing in another direction.

The invention is not limited to the illustrated embodiments but embraces all technical equivalents which can fall within the scope of the appended claims.

The positional references adopted in the description such as for example up, down, lateral and so forth are also related to the directly described and illustrated Figure and are to be appropriately transferred to the new position upon a change in position.

The invention claimed is:

1. A furniture flap drive comprising a first component having an electric motor and a second component having an actuating arm, wherein the first component and the second component can be releasably fastened together and there is provided a force transmission device for moving the actuating arm, wherein there is provided a positioning device with which the position of the force transmission device can be adjusted corresponding to at least two different angle positions of the actuating arm, wherein each angle position of the actuating arm has a different angle range between two end positions for actuating a different type of furniture flap, with the first end position being a closed position in which the furniture flap substantially bears against a furniture carcass, and the second end position being an open position of the furniture flap, wherein adjustment of the force transmission device allows only one kind of first component to be used with various types of furniture flaps.

2. A furniture flap drive as set forth in claim 1, wherein the first component can be fastened to the second component in at least three different positions of the actuating arm.

3. A furniture flap drive as set forth in claim 1, wherein the various positions of the force transmission device correspond to various opening angles of the actuating arm.

4. A furniture flap drive as set forth in claim 1, wherein the force transmission device is arranged on the first component and is configured to be brought into engagement with an interface on the actuating arm.

5. A furniture flap drive as set forth in claim 4, wherein the interface is in the form of a receiving opening.

6. A furniture flap drive as set forth in claim 1, wherein the force transmission device is in the form of a pin.

7. A furniture flap drive as set forth in claim 1, wherein the force transmission device is arranged on an eccentric transmission.

8. A furniture flap drive as set forth in claim 1, wherein the positioning device has at least one abutment element with which the force transmission device is movable.

9. A furniture flap drive as set forth in claim 8, wherein the force transmission device is displaceably movable by at least one abutment element.

10. A furniture flap drive as set forth in claim 1, wherein the positioning device has at least one actuating element.

11. A furniture flap drive as set forth in claim 10, wherein the positioning device has two actuating elements.

12. A furniture flap drive as set forth in claim 1, further comprising at least one locking element for fixing the first component to the second component.

13. A furniture flap drive as set forth in claim 12, wherein the at least one locking element is actuable by the positioning device.

14. A furniture flap drive as set forth in claim 12, wherein the at least one locking element is arranged on the positioning device.

15. A furniture flap drive as set forth in claim 12, wherein the at least one locking element is in the form of a hooked projection.

16. A furniture flap drive as set forth in claim 12, wherein the at least one locking element is configured to be brought into engagement with an abutment element is to be arranged on the second component.

17. A furniture flap drive as set forth in claim 1, further comprising an indicator device for indicating fastening of the first component to the second component.

18. A furniture flap drive as set forth in claim 17, wherein the indicator device is configured to indicate locking of the first component to the second component.

19. A furniture flap drive as set forth in claim 18, wherein the indicator device is actuable by at least one locking element.

20. A furniture flap drive as set forth in claim 17, wherein the indicator device is of a resilient nature or is spring-loaded.

21. A furniture flap drive as set forth in claim 18, wherein the indicator device is of a resilient nature or is spring-loaded.

22. An article of furniture comprising a furniture carcass and a flap mounted movably to the furniture carcass, wherein a furniture flap drive as set forth in claim 1 is mounted to the furniture carcass, and wherein the actuating arm of the furniture flap drive is connected to the flap.

* * * * *